US006298800B1

(12) United States Patent
Gala

(10) Patent No.: US 6,298,800 B1
(45) Date of Patent: Oct. 9, 2001

(54) EMBROIDERY APPARATUS

(76) Inventor: Mansukhlal K. Gala, Box 614, N. Haven, CT (US) 06473

( * ) Notice: Subject to any disclaimer, the term of this patent is extended or adjusted under 35 U.S.C. 154(b) by 0 days.

(21) Appl. No.: 09/455,286

(22) Filed: Dec. 6, 1999

Related U.S. Application Data

(60) Provisional application No. 60/111,367, filed on Dec. 8, 1998.

(51) Int. Cl.[7] ..... D05C 09/04
(52) U.S. Cl. ..... 112/103
(58) Field of Search ..... 112/103; 38/102, 38/102.2, 102.91

(56) References Cited

U.S. PATENT DOCUMENTS

| | | | | |
|---|---|---|---|---|
| 2,806,440 | * | 9/1957 | Schenkengel | 112/103 |
| 4,411,208 | * | 10/1983 | Nishida et al. | 112/103 |
| 4,497,269 | * | 2/1985 | Schneider et al. | 112/103 X |
| 4,682,551 | * | 7/1987 | Toman | 112/103 |
| 4,762,076 | | 8/1988 | Wakaizumi | 112/103 |
| 4,774,778 | | 10/1988 | Williams | 38/102.2 |
| 4,869,183 | * | 9/1989 | Moore, III | 112/103 |
| 5,884,571 | * | 3/1999 | Valadez et al. | 38/102.2 |
| 5,915,315 | * | 6/1999 | Bentz | 112/103 |
| 5,992,339 | * | 11/1999 | Mack | 112/103 |

OTHER PUBLICATIONS

"Emtiot Single Head Embroidery System" Melco Embroidery Systems, Brochure, (4) pages, (1997).
"Threading Futures Together" Melco Embroidery System, Brochure (4) pages, Undated.

* cited by examiner

*Primary Examiner*—Ismael Izaguirre
(74) *Attorney, Agent, or Firm*—C. G. Nessler

(57) ABSTRACT

A device for holding fabric during embroidering in an embroidery machine is comprised of a clamp, preferably a clamp comprised of mating rings, mounted on a clamp arm. Indicia, such as an orthogonal grid, in the form of visible fixed features, are present on the clamp arm or clamp and enable a user to easily orient and position the fabric being captured in the clamp of the device. Preferably, the clamp arm cantilevers inwardly within a generally rectangular space defined by a C shape frame which is adapted for mounting on the pantograph of an embroidery machine. The embroidering of garment pockets is particularly facilitated. Indicia are also placed around the upper surface periphery and bore of the ring of a clamp. Apparatus for facilitating the insertion of a combination of fabric and embroidery backing paper into a ring clamp is comprised structure for holding the clamp and spaced apart spring tines which hold the backing paper while the user closes the clamp.

25 Claims, 11 Drawing Sheets

EMBROIDERY APPARATUS

This application claims benefit of Provisional Pat. Application Ser. No. 60/111,367, filed Dec. 8, 1998.

TECHNICAL FIELD

The present invention relates to apparatus for embroidering textiles, particularly clothing and associated kinds of things.

BACKGROUND

Production embroidering of textiles and the like is mostly carried out using computer controlled equipment having multiple work stations. During embroidering, a local portion of the fabric of a workpiece article is held taut in an embroidery hoop or the like. The hoop and thus the fabric is moved in the horizontal x-y plane within the throat of a work station of an embroidery machine. The work station comprises a sewing head positioned above and spaced apart from a needle plate and shuttled bobbin assembly. Each sewing head comprises a multiplicity of threaded needles which move up and down, one at a time, in the vertical z-plane, penetrating the fabric and interacting with the shuttled bobbins beneath the needle plate. The hoop with clamped in place fabric is typically attached to a motorized component, called a pantograph, which moves laterally in the x-y plane in a computer-controlled manner, to move the captured fabric beneath the sewing head. Thus, through coordinated action of the sewing head, bobbins, and pantograph, the desired thread pattern which comprises the embroidery is created. Typically the embroidery equipment comprises multiple work stations, side by side, with each head having multiple sewing needles.

It is common that almost finished articles are embroidered with localized decorative designs. Shirts, caps, belts, tablecloths are typical articles which are embroidered. Thus, it is important that the embroidery be satisfactorily done since the articles have relatively high value at the time they are processed.

However embroidery is done, any flexible cloth or other article is almost always gripped within an embroidery hoop, as described. A hoop typically comprises two pieces, an outer ring and an inner ring, usually round, oval or almost rectangular oblong. One ring is smaller than the other; and, when they are engaged the fabric is captured within the space between the outside of the inner ring and the inside of the outer ring, so that the fabric is stretched across the span of the inner ring.

In production using computerized machines, the position and orientation of the embroidery on the article is a function of how the article is captured within the hoop (or how the article is "hooped"), and how the hoop is oriented with respect to the pantograph of the machine. Typically, there is a means for attaching and detaching a hoop to and from the pantograph in a relatively precise manner. Thus, the position and orientation of the embroidery on an article is largely a function of how the fabric of the article is captured within the hoop. The productivity of a particular machine is largely dependent on how rapidly the operator can properly hoop an article outside of the machine, remove an embroidered article from the machine, and install the next hooped article in the machine, with minimum of machine rest time. Obviously, if an operator is attending to a machine with multiple heads and the embroidering is fast, this can create a lot of work. In practice, it is a problem that articles are not placed in the machine sufficiently accurately or rapidly.

Once the article is hooped, in a typical present day process, there is no means for adjusting the orientation within the x-y planes. Thus, it is ordinary that a separate hooping table will be employed, and various guides, gages and rulers are used in time consuming ways to attempt to properly orient the article within the hoop.

Another kind of problem arises when a multilayered article is embroidered; as for example, when the pocket of a shirt is being embroidered. If the pocket location of the shirt is captured in the hoop, the main layer of the body of the shirt will lie very close to the outer layer which comprises the pocket. Obviously, the embroidering needles will penetrate both layers of fabric, thereby compromising the function of the pocket in the finished shirt. Similar problems arise for purses, bags and certain tubular items. There has been no good solution to this problem in the past. One poor alternative is to embroider the outer layer of the pocket prior to full attachment to the inner layer, or main body of the article. For already finished shirts with pockets, the process requires manually removing the stitches to separate the top layer of the pocket, embroidering on it, and restitching to form the pocket.

SUMMARY

An object of the invention is to facilitate the embroidering of articles in computer controlled embroidery machines so embroidering is done in a more accurate, reproducible and faster way.

Another object is to provide a better means for hooping and holding fabric articles for embroidery machine operations. Another object is to improve the embroidering of pockets and analogous things without partial disassembly of the garment or other article. Still another object is to provide improved frames and hoops for embroidering of diverse fabric articles.

In using the invention, devices are mounted in an embroidery machine, for instance on the pantograph thereof, so fabric is moved in an x-y plane during the embroidering process. In accordance with the invention, a device comprises a clamp means, for releasably holding the fabric; means for attaching the clamp means to the embroidery machine with a pre-determined x-y plane orientation; and, indicia, or markings which define an orientation and or position, upon a visible surface of the device.

Preferably, the means for attaching the clamp to the machine comprises one or more clamp arms, and the indicia are on the surface of the one or more clamp arms so the operator can see them when hooping or clamping fabric in the device. In use, a feature of the fabric, such as an edge, integral weave or knit pattern within it, or stitch line on a placket, is aligned with the indicia as the fabric is being clamped. Thus, the orientation and or position of the clamped fabric can be repeatably defined, both in the device and consequently in the embroidery machine to which the device attaches in a fixed way.

In a preferred embodiment, there is a frame assembly having x and y axes which correspond with the x and y axes of the embroidery machine. The frame of the assembly may have various configurations. Preferably, the frame is C shape and has at least three sides to define a generally rectangular space x-y plane space interior of the frame. In one such assembly, there is a single cantilevered clamp arm running inwardly into the space in the x direction, from the back of the C shape. The clamp is at the cantilever end of the clamp arm. In another configuration, two clamp arms run in the y direction from opposing sides of the frame, meeting at a shared clamp which is proximate the center of the space. Preferably, all such clamp arms have indicia on the visible surface. The unobstructed cantilever clamp arm of the frame makes the process of embroidering pockets and the like quicker and higher in quality insofar as location is concerned. The clamp means for holding fabric clamps may be of different constructions. Preferably concentric round or rectangular rings are used; and, there are indicia for aligning fabric in the bore of a ring and or on the top surfaces of such rings. Preferably, such rings have selectively increased z axis thickness, which provides strength.

In another aspect of the invention, discrete pieces of fabric, such as labels, are held singly or in multiples on a clamp arm which has a plurality of openings, each slightly smaller than the exterior dimensions of a discrete piece of fabric which is to be processed. In one design there is a hinged cover plate with multiple opening(s) corresponding with those in the clamp arm. In an alternate design there is a multiplicity of single opening hinge plates. The hinge plates are adapted to press onto the clamp am surface to thereby press down on the discrete pieces and hold them in place.

In still another aspect of the invention, free standing apparatus holds the aforementioned C shape frame assembly for and during the hooping of fabric articles, especially those having pockets and the like. The apparatus has slotted tines which are positioned on either side of the cantilever clamp arm of the frame when the frame is set in place. The tines make it easy to secure a combination of fabric and backing paper or top film in the clamp of the frame assembly, when it is desired to have paper or film.

The foregoing and other objects, features and advantages of the present invention will become more apparent from the following description of preferred embodiments and accompanying drawings.

DESCRIPTION

The invention is described primarily in terms of its use in the process of creating a threaded embroidery design on textile fabric, such as a portion of a cloth garment or the like; and, in terms of using a computer controlled embroidery machine of the type referred to variously as a tubular machine, tubular goods machine or cylindrical arm machine. While only one sewing head and associated components are referred to below, it is common for production machines to have a multiplicity of sewing heads, side by side. Those skilled in the field will appreciate that various embodiments of the invention will be useful in flat table type embroidery machines as well; and, the invention will be useful in connection with other configurations of embroidery machines, including light duty single head machines and those used primarily by home sewers.

The invention will be understood to be generally useful for embroidering all kinds of things, other than garments. It will be useful for processing or finishing of textile and non-textile sheets by means of other processes than embroidery, where the processes require a portion of the article to be held taut and moved during manufacturing. The term fabric as used herein is intended to encompass all sorts of flexible textile and non-textile sheets, including paper and plastic sheets, which must be held taut during embroidering.

Figure 1:
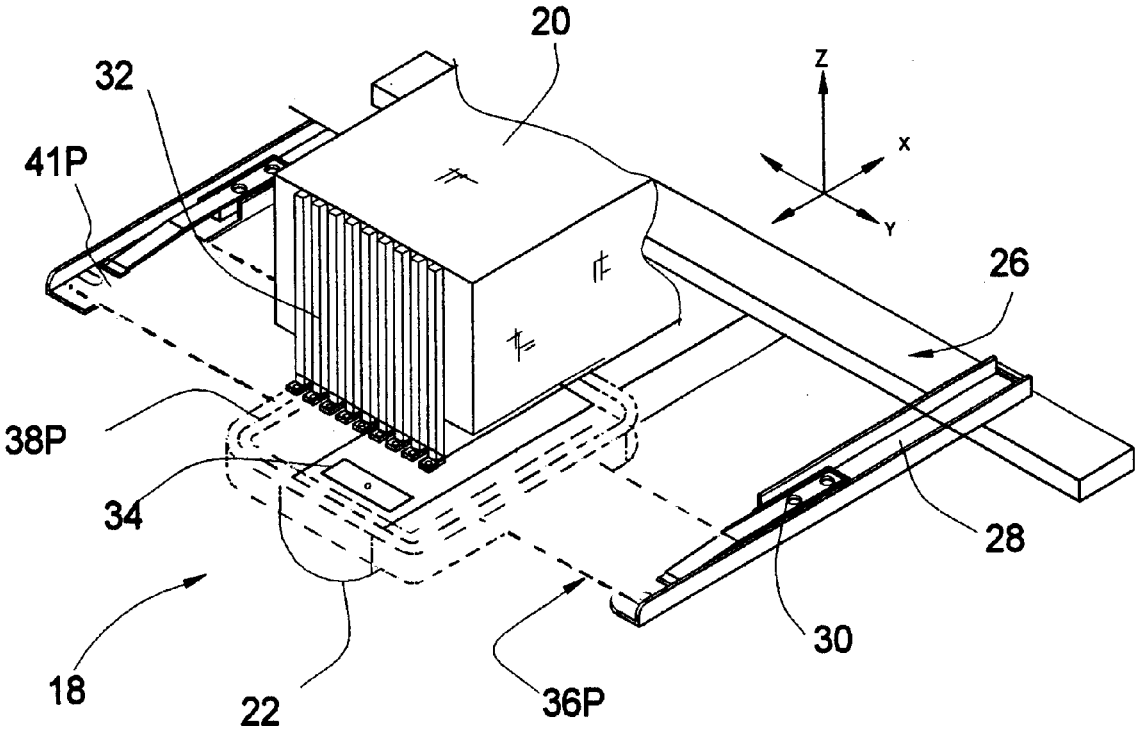
FIG. 1 (PRIOR ART)
FIGS. 1 and 2 show a perspective and front elevation views, respectively, of the essential elements of a pantograph style embroidery machine used in the prior art and in the invention.
Figure 2:
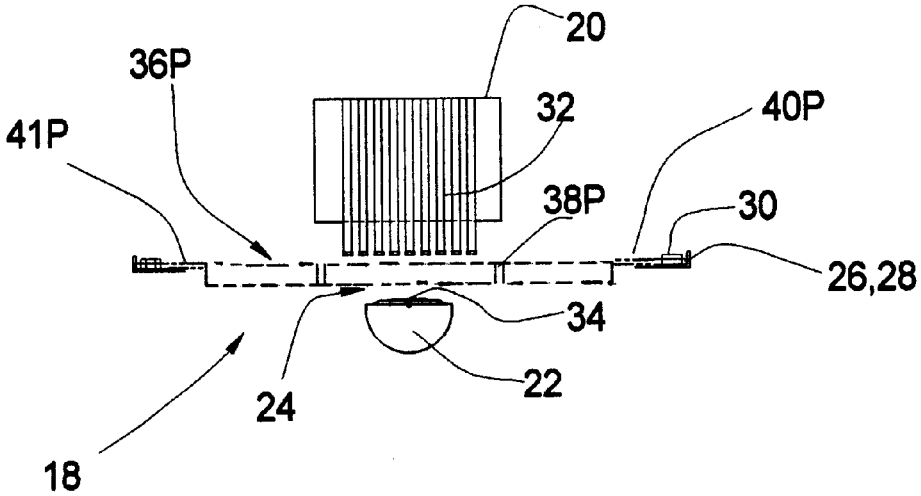
FIG. 2 (PRIOR ART)

FIG. 1 is a perspective view, and FIG. 2 is a front elevation view, both showing in semi-schematic fashion the essential parts of the a single sewing head prior art embroidery machine 18. The sewing head 20 has an array of threaded needles 32 which are positioned over the needle plate 34, which is on top of the of the cantilever cylinder arm 22. The fabric or garment workpiece (not shown) is positioned on a hoop within the throat 24, or space between the head and needle plate. The fabric is held taut by being stretched across the opening of a ring which is a portion of a hoop. The hoop is also sometimes referred to as a frame. In FIGS. 1 and 2, a rectangular ring 38P is part of hoop 36P, shown in phantom. The ring 38P may alternatively be circular. In general the ring is of a dimension which suits the size of the embroidery which is being applied. The hoop 36P has opposing side flanges 40P, 41P which detachably mount on the arms 28 of the pantograph 26. Spring clips 30 engage holes or other features of the flanges 40P, 41P for positive and polarized engagement of the hoop to the pantograph arms. In operation, the pantograph moves both from side-to-side and forward and backwards, in the x and y axis directions as indicated by the axis arrows in FIG. 1, responsive to signals from a computerized control system, as selected needles move up and down in the z axis direction, to insert thread through the fabric. In the generality of the invention, machines having other constructions, but which achieve the same essential embroidering action, may be used in conjunction with the invention.

Figure 3:
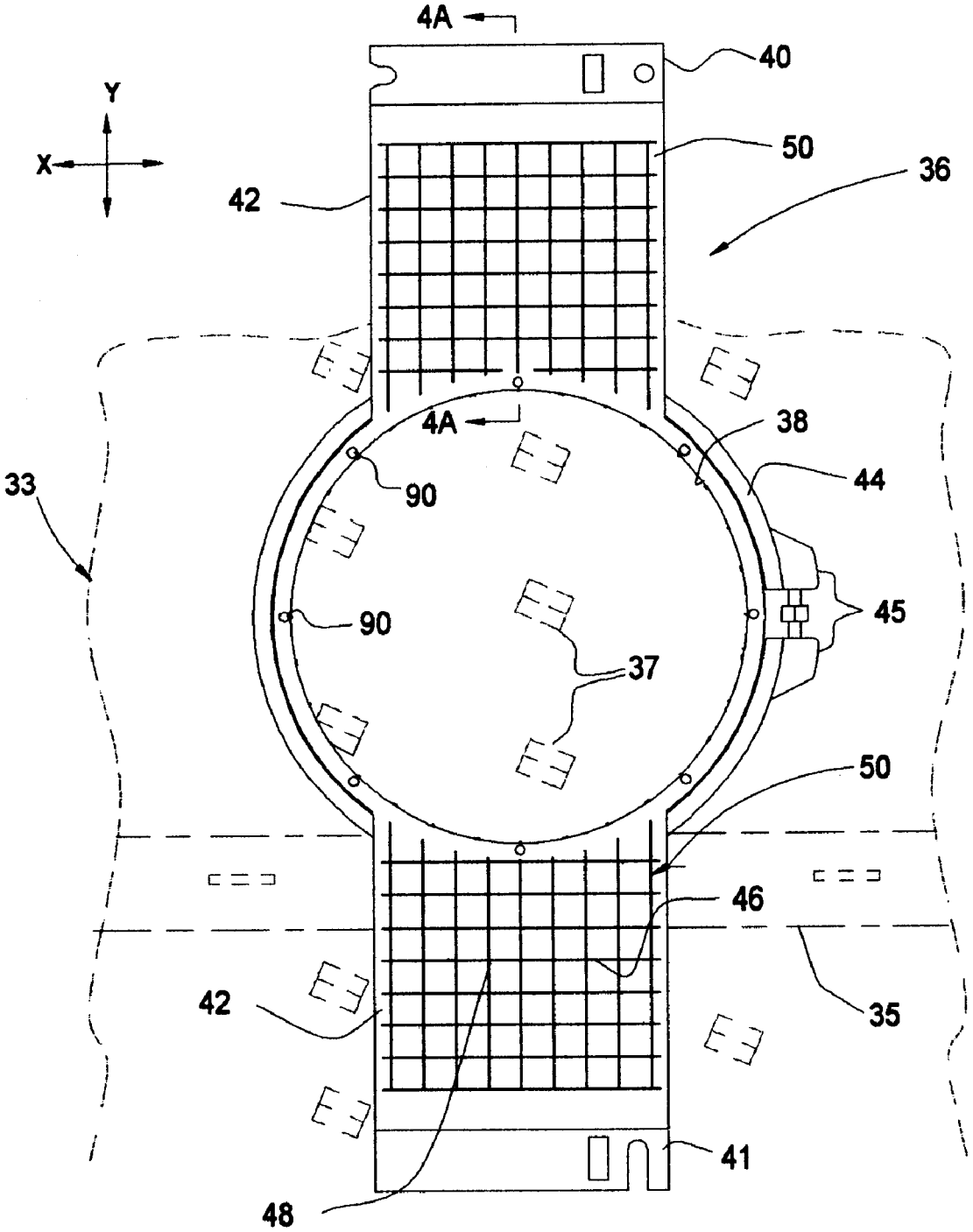
FIG. 3 is a top view of a hoop or embroidery frame having clamp means comprised of two concentric rings, and having indicia on the clamp arms for aligning fabric. A portion of a fabric shirt is also shown, in phantom.
Figure 4A:
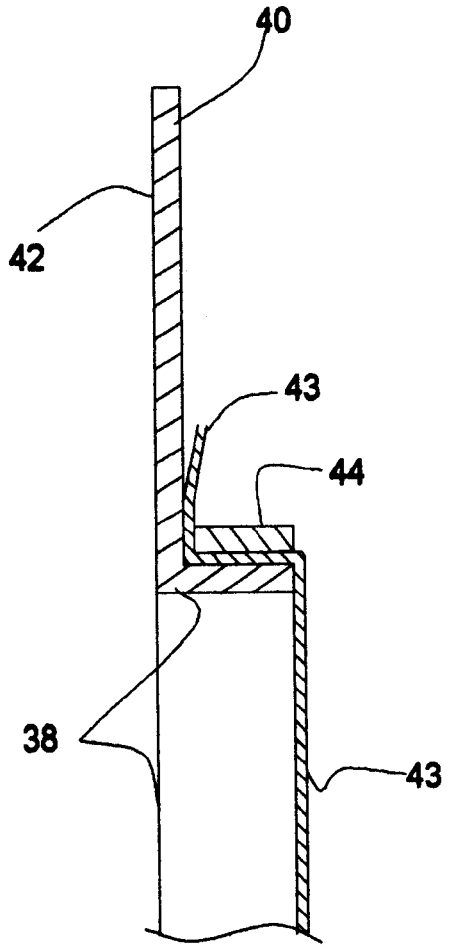
FIG. 4A is a partial cross section of the device shown in FIG. 3, showing a piece of cloth captured in the device.

FIG. 3 shows a hoop 36 of the present invention. It is in many respects like the prior art hoop. It is an essentially flat article, with a central circular opening defined by an integral ring 38. The ring 38 is supported by opposing side hoop arms 42 which terminate in opposing flanges 40, 41. The flanges 40, 41 are adapted to engage the pantograph arms of the embroidery machine in polarized fashion. As is familiar in the prior art, a portion of the fabric to be embroidered is captured between two concentric rings so during use fabric is stretched across the opening of ring 38. In the FIG. 3 hoop, a removable outer ring 44 circumscribes the outside circumference of ring 38. In use, ring 44 is frictionally engaged with the fabric which lies along the outside of the ring 38. See FIG. 4A. As is familiar, the diameter of ring 44 is adjustable by screw clamp mechanism 45, to accommodate different thickness fabrics. The device is made of metal, wood and or strong plastic, such as glass filled nylon or ABS.

Figure 4B:
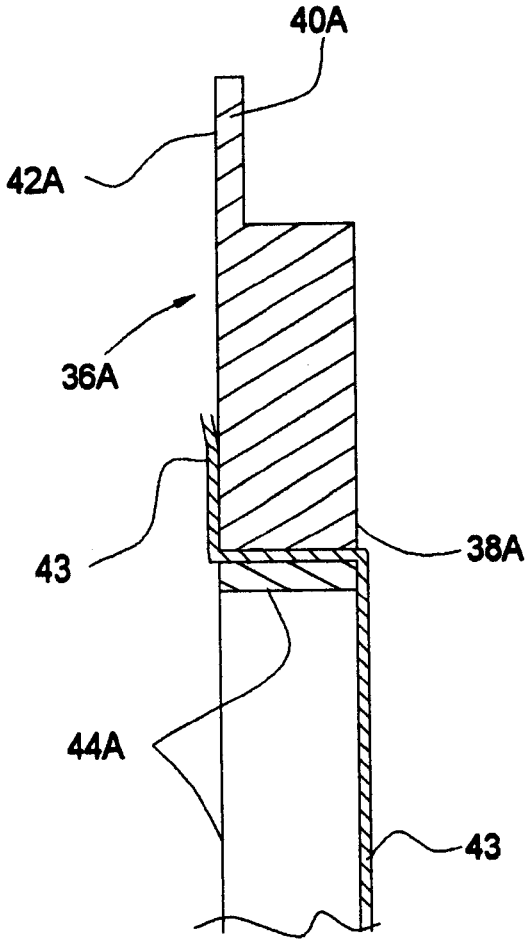
FIG. 4B is similar to FIG. 4A, showing a hoop having a clamp with a removable inside ring.

In another embodiment of the two-arm hoop, illustrated by the fragment shown in FIG. 4B, hoop 36A comprises a removable ring 44A which fits inside the ring 38A. Thus, hoop 36A holds the fabric 43 somewhat differently from hoop 36 which is a more widely used type of ring clamp configuration. The inner ring of the FIG. 4B embodiment, as with any other corresponding removable rings that are described herein, may also be of adjustable diameter, as mentioned for ring 44.

Each arm 42 has markings, or indicia 50, on its upper surface (that is, the surface which faces the operator when setting the fabric in place), as illustrated for hoop 36 in FIG. 3, where the markings are in the form of an orthogonal grid, that is, mutually perpendicular sets of parallel lines. The line sets are aligned with the principal x-y axes of the hoop, as shown in the Figure, and when the hoop is on the pantograph, the x-y axes of the hoop correspond with the x-y axes of the pantograph motion of machine 18. The lines provide the means for visually aligning and locating the fabric as it is being clamped within the rings of the device.

In FIG. 3, the hoop 36 is shown superimposed on a portion of shirt 33, shown in phantom, to illustrate how the indicia are useful when fabric is clamped into the hoop. The phantom diamonds 37-are suggestive of an imprinted pattern or other visible surface feature of the shirt, such as integral weave or knit pattern. The ring 44 is first removed and laid on a work table. The fabric is laid loosely on top of the ring. The hoop 36, is placed onto the fabric at the desired location. The operator aligns the grid at the edges of the arms, or imaginary extensions of the x axis indicia of the grid, with a predetermined feature of the fabric, for instance a finished edge, so that the fabric becomes properly positioned within the bore of the inner ring 38. In FIG. 3, the edge 35 of a button hole placket is shown so aligned. Then, while the fabric is manually held in place against the underside of the ring 38, and the ring and fabric are pressed down and into the bore of the outer ring 44. Alternatively or additionally, the operator aligns a feature such as those suggested by the phantom diamonds (see just above) with the imaginary x or y direction extensions of the grid. Thus, the fabric will be in a predictable location within the x-y working field of the embroidery machine when the hoop is placed in the embroidery machine.

Figure 5:
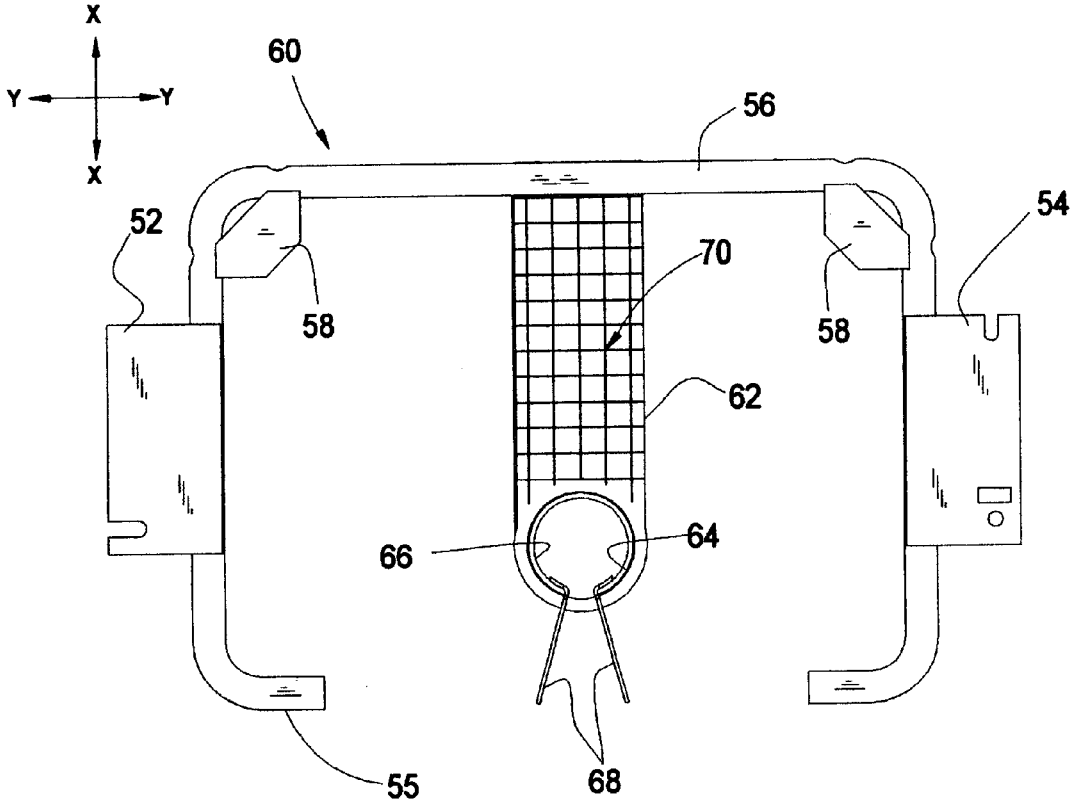
FIG. 5 is the top view of a frame assembly comprised of a generally rectangular C shape frame for use in a typical embroidery machine. There is a clamp at the end of a cantilever clamp arm and indicia on the top surface of the clamp arm.

FIG. 5 shows in top view a frame assembly 60 which is adapted to be held on the arms of the pantograph of an embroidery machine. The particular frame is especially suitable for embroidering pockets of garments, and other articles which present similar problems in that the embroidering ought only be through the single outer layer of fabric. A cantilever arm 62, having an orthogonal grid 70 on the surface, extends into the generally rectangular interior space defined by a frame 56 made of aluminum bar stock. At opposing y axis ends of the frame are flanges 52, 54. The flanges are adapted to engage the arms of a standard pantograph in typical polarized fashion. As illustrated, there are prior art polarized holes which mate with features of the pantograph arms, and a spring clip typically is employed to keep the frame (as with the prior art hoop) in place. Webs or braces 58 stiffen the rear corners of frame 56. The arm 62 is bolted to and cantilevered from the back side of the frame. The surface of the arm has a grid 70, like that previously described. A hole at the outer end of arm 62 conceptually defines the interior of a ring 64 which is adapted to receive inner retainer ring 66. The inner ring may be like that previously described. In FIG. 5 another design of removable inner ring is shown. The ring 66 is made of flat spring steel, and has tabs 68 which, when manually pushed toward one another, release the outward force against the bore of ring 64. Ring 66 may alternately be made of round cross section wire, and ring 64 may have a circumscribing interior groove to receive the wire. The tabs 68 desirably have a rough surface or other frictional surfacing, to facilitate the operator's grip of the ring 66.

Figure 6:
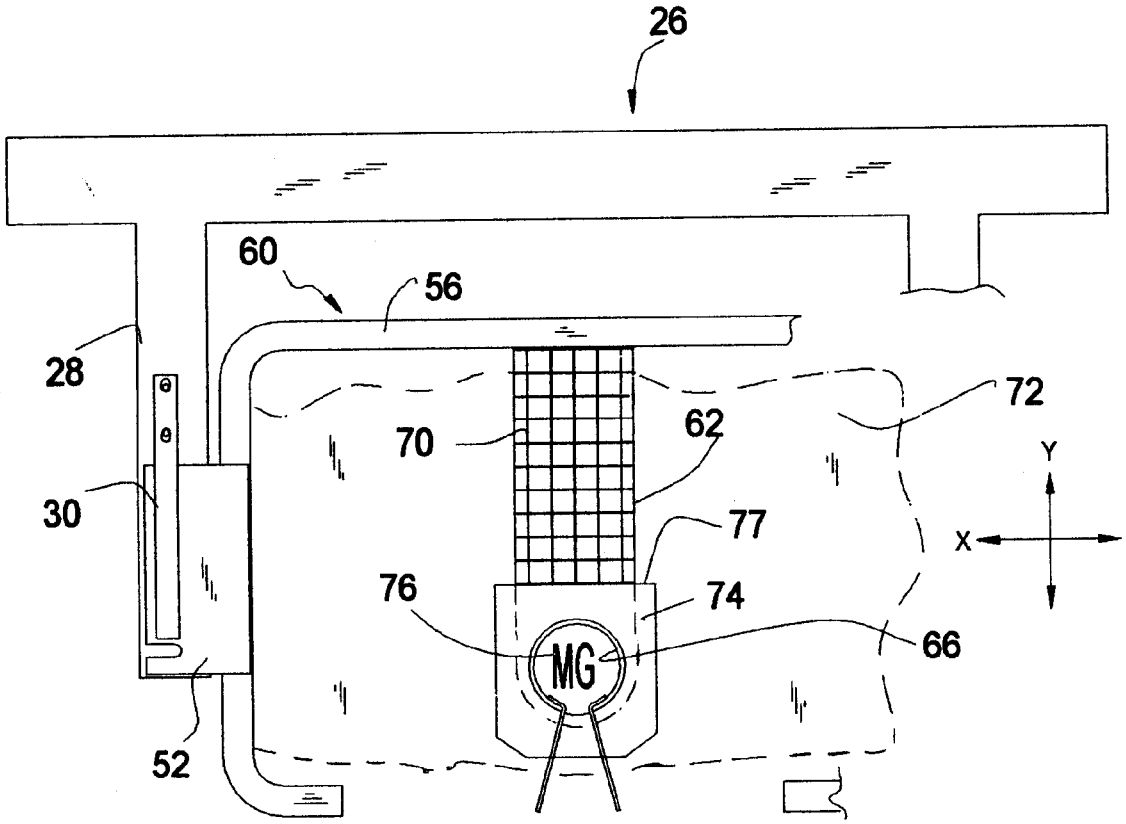
FIG. 6 shows the frame assembly of FIG. 5 with the pocket part of a garment captured in the clamp, when the frame assembly is mounted on the arms of the pantograph of an embroidery machine.

FIG. 6 illustrates how the frame assembly of FIG. 5 mounts on the pantograph 26 of an embroidery machine. FIG. 6 shows how the indicia of the grid of the arm are used when the pocket 74 of a shirt 72 is embroidered. The top layer which defines the pocket 74 is shown as it is captured by the removable ring 66 set in the ring hole of the arm 62 which arm extends into the interior of the pocket. In the Figure, the garment is shown after embroidery of a thread pattern 76, in the example, the letters "MG". In the use of the invention, prior to the operator placing the ring 66 within the bore of the hole in the arm, to fix the cloth in place, the operator visually aligns the top edge 77 of the pocket part with a predetermined line of the grid. This establishes both a defined x axis location and x-y plane orientation of the pocket edge, and thus of the portion of the garment which is being embroidered, with respect to the frame 56, and thus with the machine axes when the frame is mounted on the pantograph as shown.

The width of the arm 62 is obviously equal or less than the width of the pocket opening. Thus, visual centering of the pocket on the arm may be used. Alternatively, if there is a feature on the shirt, such as a pattern, seam, button, etc., that also may be used for obtaining y axis location and or an x axis location as well. Accordingly, since the x and y positions, and the rotational position in the x-y plane are established for each garment, embroidering can be readily accomplished in a precise and repetitive manner.

Figure 15:
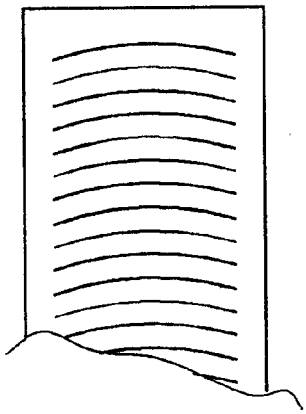
FIGS. 15, 16 and 17 respectively show curved, angled and spaced apart dot indicia on clamp arm portions.
Figure 16:
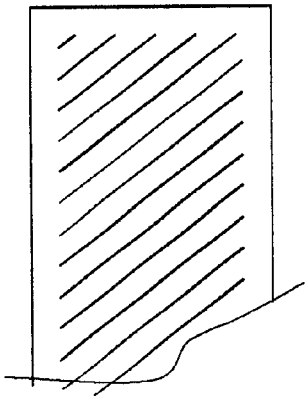
Figure 17:
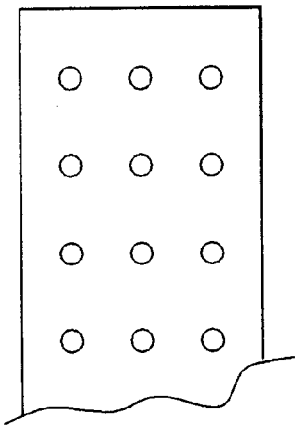

In the examples of FIGS. 3 and 5, and in other embodiments of the invention, the individual lines of the grid may be delineated by letters, numbers or other characters or markings to facilitate the selection of the proper line with which alignment ought be made. Obviously, the grid spacing may be calibrated in any desired manner and may be regular or irregular. For example, the lines may be spaced apart a certain number of millimeters, and any particular line(s) may be set at a predetermined location relative to the head when the pantograph is at its home position. In the practice of the invention, it is not necessary to have a grid. For example, only one or more x-direction or y-direction lines may be present. FIGS. 15–17 illustrate other types of indicia to suggest the generality of the invention. FIG. 15 shows concentric lines; FIG. 16 shows angled lines; and, FIG. 17 shows space apart dots. In the preferred practice of the invention, the indicia will be of a character sufficient to establish both the position and orientation of the fabric, as is the above described grid. In the generality of the invention, indicia will enable establishing either the position or the orientation, and not necessarily both, as such may be sufficient for some applications. The indicia may be applied by any of a variety of ways. For example, they may be embossed, scribed, printed, painted or applied by decals. See the further discussion below about rings used for clamping. The indicia will be located on a portion of the device which is visible to the user when fabric is being secured within the clamp means. As indicated by the examples herein, the indicia are preferably on the arm and clamp, but within the invention, indicia may also be placed on other portions of the assembly of which the clamp means is a part.

When the frame assembly 60 with fabric captured in the ring clamp is mounted on the pantograph, i.e., in position for sewing, the part of the garment (shirt, in the example) which is the interior surface of the pocket and lies underneath the arm 62 may also underlie the cylinder arm 22 of machine 18. Alternatively, the interior fabric is folded away in the y axis direction, so as to make the exterior fabric of the pocket, that which is stretched taut in the ring, lie directly above the needle plate of the cylinder arm. Generally, one or the other procedure will be achieved, but there may be certain garment configurations and embroidery locations which may not permit such. While the frame is held on the pantograph, the embroidery machine is activated to make the embroidery, and the pantograph moves in a programmed x-y fashion while the needles insert the thread. When the embroidery is done, the frame may be removed from the machine. As described below, this is preferable. The machine may embroider a first garment in a first frame while the operator sets up a second garment for embroidery in a second frame. When the first is completed it can quickly be interchanged with the second, to maximize machine production.

Referring again to FIG. 5, when viewed looking down the z axis into the x-y plane, the frame 56 has a C shape. The frame mostly circumscribes the interior rectangular space. The frame has parts, stubs 55, which run along the front side of the frame and serve as handgrips for attaching and detaching the frame to the pantograph. In other C shape configurations, the stubs 55 may be eliminated, so the frame has only three sides; and, in others, the stubs have a different orientation, for instance, in the x axis or oblique; and, in still others, the stubs provide a structural function when braces or arms from the clamp means run to them.

Preferably, the arm 62 cantilevers from the center of the rear side of the frame 56, and thus it is nominally in the center of the opening of the C shape. Likewise, the center of the clamp is preferably in the center of the frame, and thus the embroidery areas will be in the center of the machine work area. In other embodiments, the arm may cantilever into the interior space at an angle and from a different location. For instance, in some light duty machines, the working end of the cylinder arm extends in the y axis direction, and thus it is desirable to have the clamp arm extend likewise.

Figure 18:
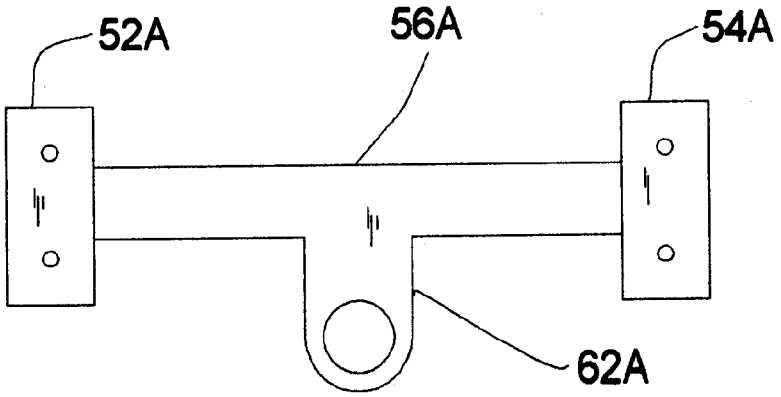
FIG. 18 is a top view of a single straight member frame, for mounting on a pantograph, where the arm with clamp is cantilevered from near the center of the member.

The frame may have other configurations. For instance, FIG. 18 shows a straight member 56A running between the y axis ends 52A, 54A which engage the pantograph, and the arm 62A cantilevers from approximately the midpoint of the member. Enclosed or partially open frames which have other than the generally rectangular shape of the preferred embodiment are within contemplation. For instance, the frame may have a triangular, oval, circular or hexagonal shape.

In another aspect of the invention, a two arm hoop, like that shown in FIG. 3, may be mounted within a frame like that shown in FIG. 5. The arms 42 can thus be characterized as being cantilevered from opposing sides of the frame, so the ends are interconnected by the ring clamp, or whatever type of other clamp means is used.

Figure 7:
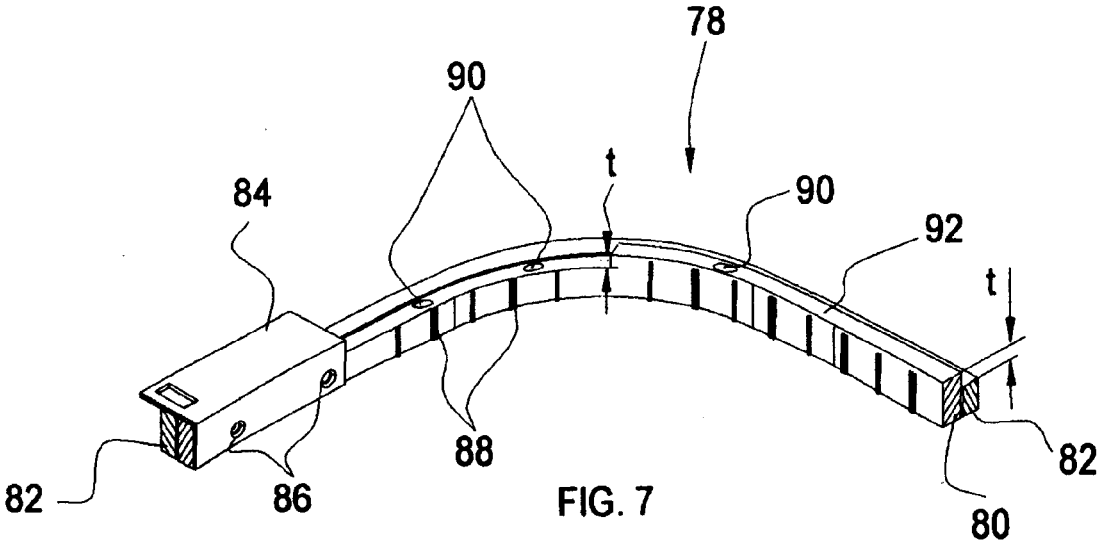
FIG. 7 is a fragmentary perspective view of the corner of a rectangular two-ring clamp, showing indicia within the bore and on the top surface of the clamp, and an inner ring having locally increased z axis thickness, for strength.
Figure 8:
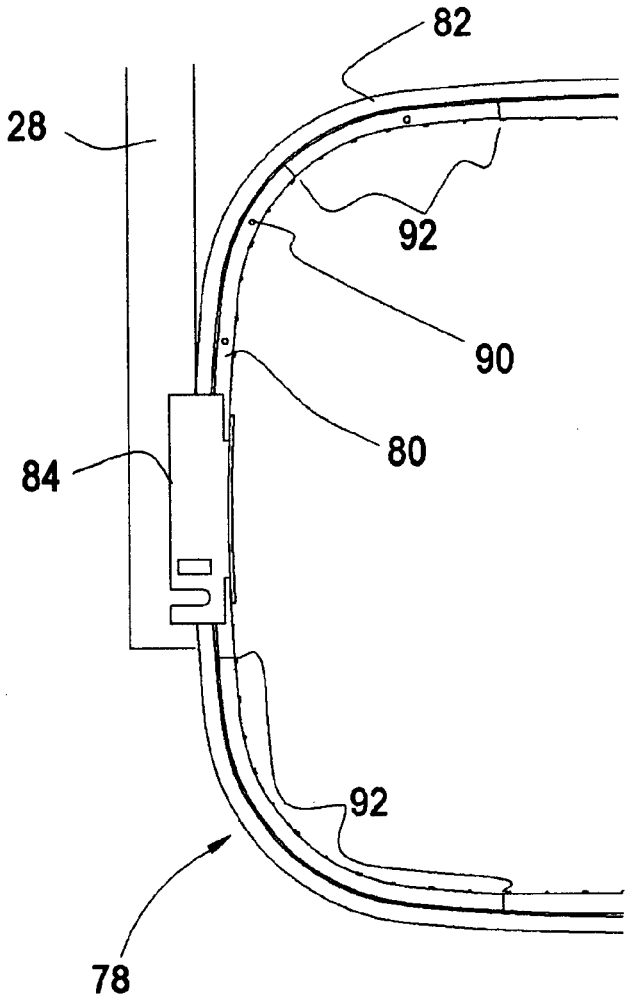
FIG. 8 is a top view of part of the device shown in FIG. 7.

FIG. 7 illustrates still another aspect of the invention. FIG. 7 is a perspective view of a portion of a generally rectangular hoop 78, largely similar in overall construction to that which has been used in the prior art. FIG. 8 shows the same hoop 78 in partial top view, i.e., looking down the z axis, together with a pantograph arm 28. The hoop 78 comprises flanges 84 (one shown) which are attached to the inner ring 80 by screws 86 or other means. Removable outer ring 82 fits around the exterior of the fixed inner ring, in accord with the previous description.

In this aspect of the invention, the clamp means is fitted with indicia, for similar purpose to the indicia on the arms. In the rings of FIGS. 7 and 8, the inside of the inner ring 80 has spaced apart vertical lines, such as scribed lines. The lines on opposing inside surfaces are precisely placed. Some lines may be double thickness or otherwise distinguished, to enable quick visual identification of corresponding lines on opposing interior faces of the ring. The lines, or such other markings as are used, may be placed at regular bearings with respect to the central z axis of the space circumscribed by the hoop. For instance, lines may be put at 3, 6, 9 and 12 o'clock locations, and whatever smaller increments therebetween that may be desired. With such, the operator will appreciate the symmetry of the markings around the ring; and, he or she can select particular markings which are symmetrical to a center point. For instance 10 o'clock and 2 o'clock markings are symmetrical to 12 o'clock. Thus, as an example, widely spaced apart stripes of a fabric can be visually spaced equally with respect to the 10 and 2 o'clock markings, and the operator will know the symmetry of the left-right positioning of the fabric within the opening of the ring.

Thus, when a fabric has texture, lines or other regular patterns, it is easy for the operator to consistently align the fabric rotationally within the opening of the hoop as she or he grips the fabric while pressing the removable ring into place. Likewise, vertical marking lines are useful on the interior of a removable ring which fits inside the bore of the fixed ring of a hoop or frame assembly, when the removable ring is polarized, or bipolar and symmetrically marked in the case of a non-circular shape ring, such as an oval or rectangle. Another way of applying indicia to a clamp, in this case the ring, is by means of small protrusions 90 on the top surface of ring 80. In analogous fashion to the interior marking lines, the protrusions provide both a visual and tactile indicia. The regularly spaced protrusions are especially useful on round ring hoops, where they may be placed at selected "clock number positions". See FIG. 3.

FIGS. 7 and 8 also illustrate how an inner ring 80 has selected portions 92 which have a vertical or z axis thickness which is greater, by dimension t, than the adjacent portions of the ring 80. The height of portions 92 is also greater than the height of outer ring 82 in the embodiment shown. The greater thickness provides greater local rigidity to the ring. The ring 80 thus has a serrated upper surface. In a typical embroidery machine it is not possible to make the whole ring of greater thickness because the ring would hit parts of the head during pantograph motion, owing to the relatively small vertical spacing in the throat. Nonetheless, appreciable benefit is obtained and the steps or height changes provide indicia. In other embodiments, the outer ring 82 of FIG. 7, 8 may also be made to be serrated, although generally this have not been found to be particularly advantageous. The principles just described may also be employed on hoops where the removable ring is on the interior of the fixed ring, rather than on the exterior, as shown.

Figure 9:
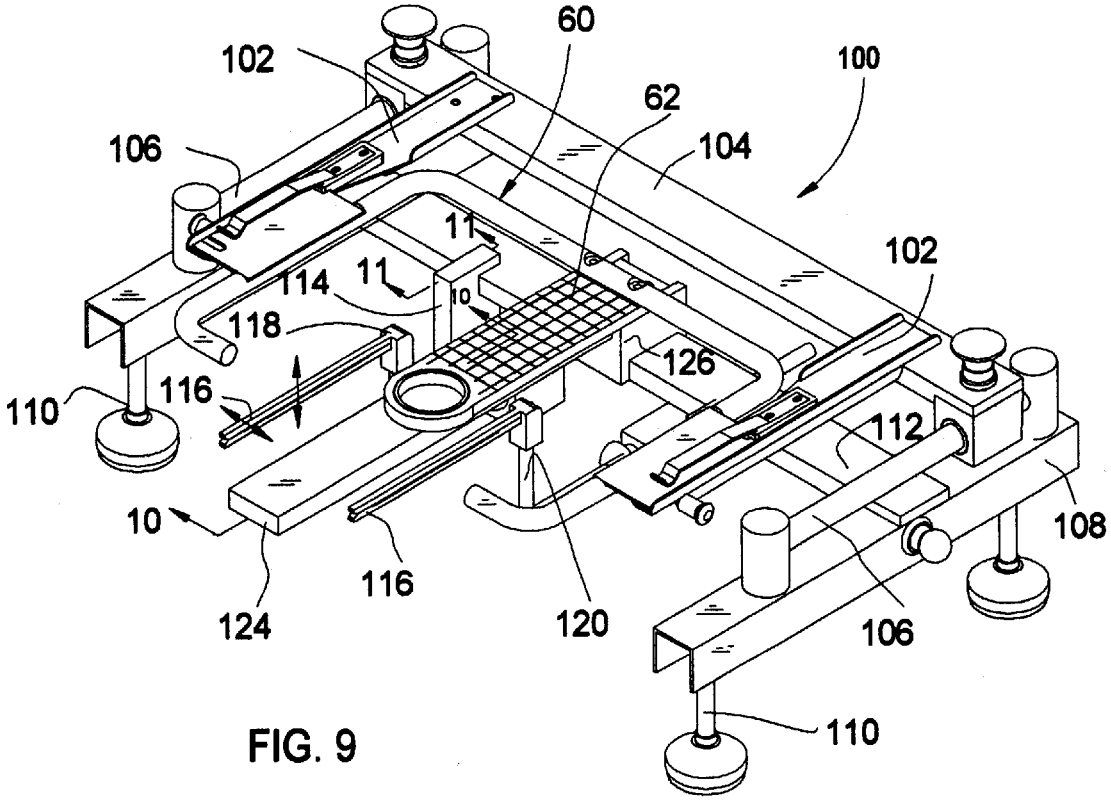
FIG. 9 is a perspective view of a hooping station, or apparatus for holding a frame assembly like that shown in FIG. 5, while an operator positions fabric within the clamp, with a frame assembly in place.
Figure 10:
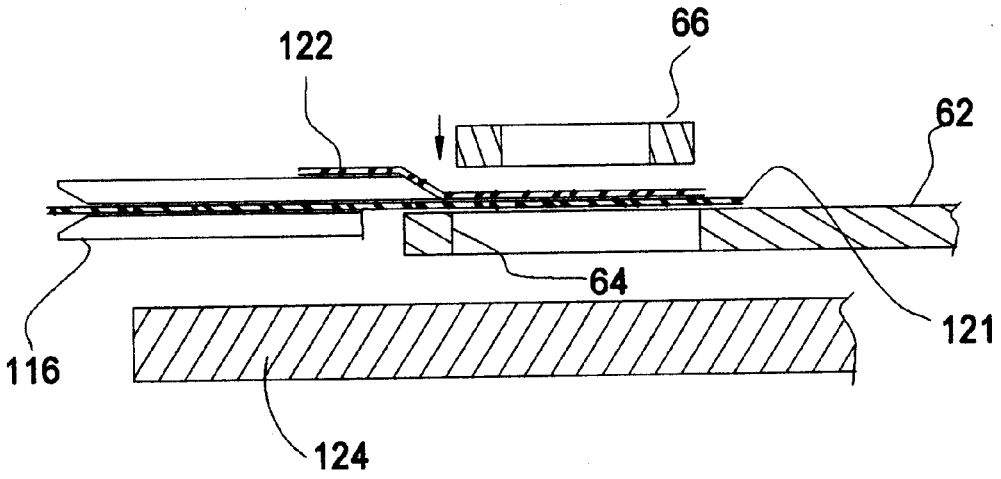
FIG. 10 is a partial cross section elevation view of the apparatus of FIG. 9, showing how tines hold a backing paper while it and fabric are being captured in the clamp at the end of the clamp arm of a frame assembly.
Figure 11:
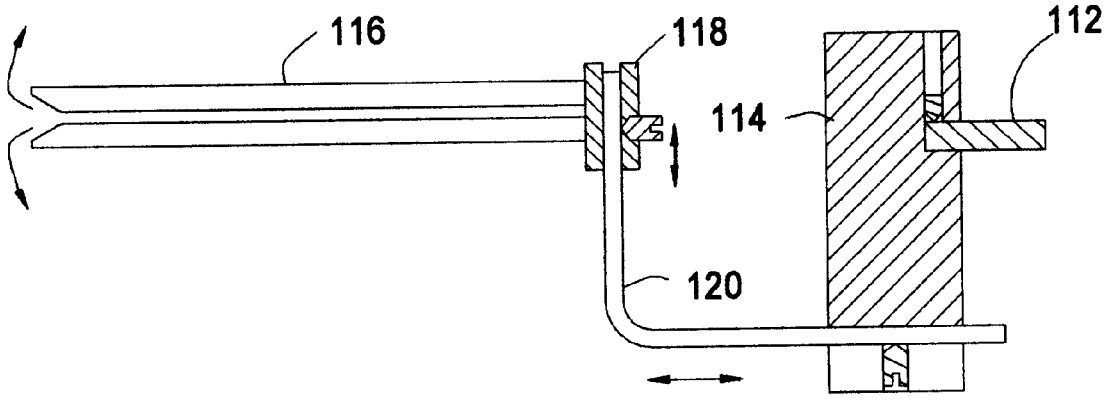
FIG. 11 is a partial cross section elevation view of the apparatus of FIG. 9, showing how tines are adjustably mounted.

Returning again to the frame assembly shown in FIGS. 5 and 6, and the Background, it is generally desirable for efficient production that an operator will have hooped, or mounted the fabric to be embroidered on the frame assembly 60, prior to the frame assembly being placed in the machine. FIGS. 9, 10 and 11 show apparatus 100, referred to as a hooping station. It facilitates doing that, particularly where a backing paper or top film is used to aid embroidering. The apparatus is comprised of a base 108 which is supported on four legs 110. The opposing sides of the base are connected by lower cross member 112 and upper cross member 104. Arms 102 which are functionally similar to pantograph arms extend from the upper member 10, and they, with center support 126, receive the frame assembly 60. The frame assembly is shown in position on hooping station in FIG. 9. Member 104 may be fixedly positioned at selected front-to-rear locations by moving the member along rails 106. The left-right location of arms 102 is set according to the embroidery machine design and obviously may also be adjusted, although that feature is not shown.

With reference to the partial vertical side-view cross sections of FIGS. 10 and 11 and FIG. 9, split guide tines 116 are adapted to receive and help hold a backing paper 121 which underlies the fabric 122 after it is hooped. See FIG. 10 which shows the components as ring 66 is being lowered into position. The tines are also particularly useful for holding and placing a top film. The backing paper and top film tend to be small curly pieces and thus hard to handle. The tines 116 spring apart slightly when backing paper or the like is run along the tine split in the y direction, and then spring back into position to hold the paper or film. Obviously, the tines can also be used to hold pieces of fabric, without paper or film. The tines extend from sleeves 118 which are vertically moveable along L-shape bars 120 so they can be adjusted vertically. The bars 120 slide within blocks 114, for fore and aft adjustment of the tines. The blocks 114 move left-right along member 112 to change the spacing between the tine pieces and relative to the frame assembly, in particular the arm. When a desired position is achieved, tightening of set screws inhibits the foregoing motions. The cantilever table 124 is at a z axis elevation which is lower than the elevation of the x-y plane of the frame. The table simulates the presence of the top (needle plate portion) of a tubular arm of an embroidery machine, and assists in holding the garment in place while it is being clamped.

The aspects of the invention which involve the marking of the hoop or frame with a grid or other visual and tactile locating features, and which involve the use of the hooping station, have been described in terms of the fabric being held by the concentric or mating rings.

While rectangular and circular shape rings for clamps have been mentioned, various other shapes may be employed for rings and other clamping means. For example, the rings may be triangular or oval. The rings ought to be given a surface texture, such as the finish which is produced by sandblast of the mold used for injection molding. Preferably the surface finish will be rougher than 32 microinch/inch Arithmetic Average.

Figure 19:
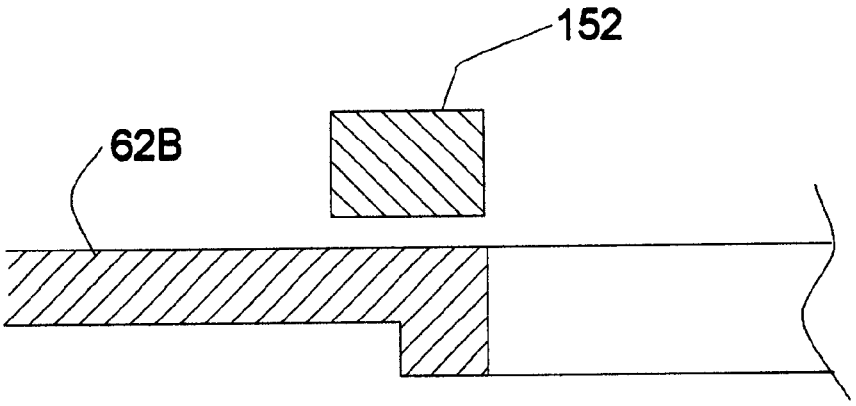
FIG. 19 is a partial cross section through the clamp arm and ring of a clamp which uses magnetic force to hold the fabric.
Figure 20:
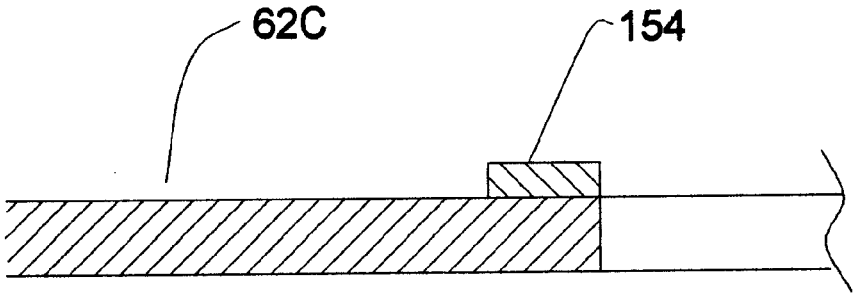
FIG. 20 is like FIG. 19, showing a clamping means which comprises an adhesive for holding fabric.

Other ways of temporarily holding fabric than using rings are within contemplation of the meaning of term "clamp means". For instance, the fabric can be engaged with an arm by other kinds of mechanical clamps. What is feasible will depend on the character of the fabric and embroidery. As examples of other clamping means, the partial vertical cross section of FIG. 19 shows how a magnetic ring 152 can be employed with a arm/ring 62B having suitable magnetic character, e.g., being made of steel. FIG. 20, analogous to FIG. 19, shows how a layer of adhesive 154 on the arm/ring 62. The adhesive may also be applied to the fabric.

Figure 12:
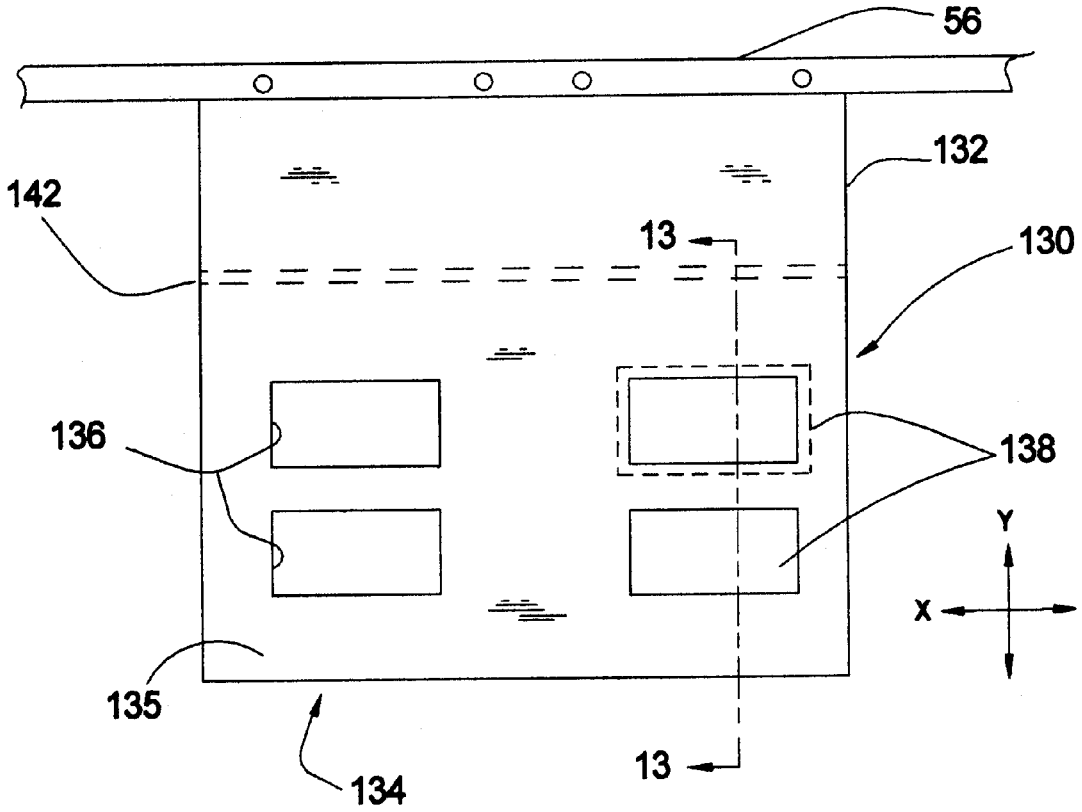
FIG. 12 is a top view of a clamp arm with a hinged multiple-opening clamp plate, for holding four labels or the like during embroidering.
Figure 13:
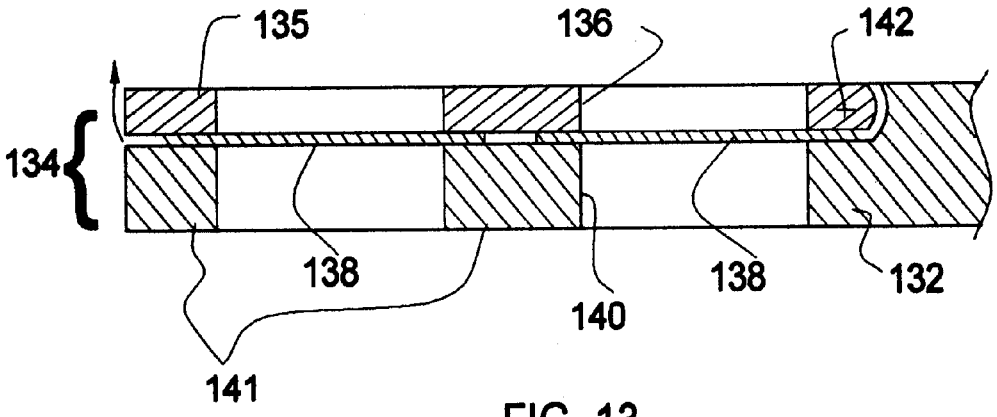
FIG. 13 is a partial elevation cross section of the device shown in FIG. 12.

The top view of FIG. 12 and the partial cross section view of FIG. 13 show an arm and clamp assembly 130 which is particularly useful for embroidering of small discrete pieces of fabric, such as labels. In the Figures, the exemplary assembly holds four identical rectangular labels 138 a four clamping locations. It will be readily envisioned how the invention is applicable for more or fewer labels and the like, and to ones which have other shapes.

Figure 14:
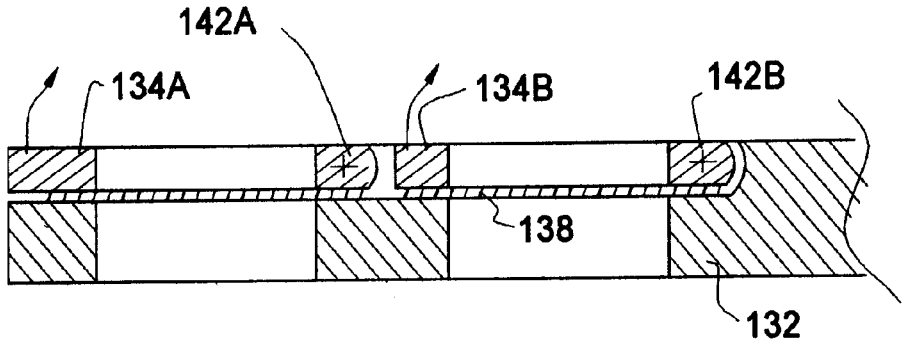
FIG. 14 is like FIG. 13, showing in partial elevation cross section a device similar to that shown in FIG. 13, but where there is a separate clamp plate for each label.

The arm 132 is cantilevered from frame 56. The outer end of the arm comprises a bottom plate 141. Clamp 134 comprises the bottom plate and top plate 135 which is hinged from the arm at pivot 142. Means for securing the top plate to the bottom plate are not shown, but latches and the like will be obvious to the artisan. The two mating plates have respective openings 136, 140 which are smaller than the dimensions of the label 138. Thus, when the clamp is closed, the labels are held securely, and when the assembly 130 is placed in an embroidery machine, embroidery of the labels is quickly and accurately accomplished. FIG. 14 shows an alternative design, where there are a multiplicity of separate plates 134A, 134B, etc., pivoted from points 142A, 142B, etc., one for each label which is to be held.

Indicia, pockets, or other features on the upper surface of the arm, proximate the openings 140, which will be visible when the top plate(s) is raised, are employed to assist the operator in quickly positioning new label blanks. Resilient gaskets or other means for enhancing the frictional engagement of the clamp and arm surfaces with the labels may be employed.

The invention has been described in terms of an embroidery machine and process which involves putting thread through the article. Within the scope of the invention, will be the creation of surface features on articles by use of monofilaments, wires and other materials. Also within the meaning of embroidery as used herein, and thus within the invention scope, will be the creation of surface features on garments and other articles by means which substitute for needles, thread, etc., used in traditional embroidery. For instance, paints, powders with binders, and other flowable substances may be deposited on a point by point basis, analogous to familiar ink jet printing technology, to create a detailed surface feature on a garment or the like, in substitution of traditional embroidery.

Although this invention has been in other ways shown and described with respect to a preferred embodiment, it will be understood by those skilled in this art that various changes in form and detail thereof may be made without departing from the spirit and scope of the claimed invention.

I claim:

1. A device for holding a fabric in an embroidering machine which is adapted to move the fabric in an x-y plane during embroidering, which comprises:

clamp means, for releaseably holding the fabric;

means for attaching the clamp means to the embroidering machine in a predetermined x-y plane orientation; and, indicia upon a visible portion of the device which is fixedly positioned relative to the means for attaching, for enabling visual alignment of fabric with the indicia when the fabric is being clamped within the clamp means.

2. The device of claim 1, which further comprises means for attaching which includes a clamp arm attached to the clamp means, wherein the indicia are on the clamp arm.

3. The device of claim 2, further comprising a second clamp arm like the first clamp arm, attached opposingly to the clamp from the first clamp arm, each clamp arm having means for attachment to the embroidery machine.

4. The device of claim 2, adapted for use with an embroidering machine having a sewing head and a pantograph wherein the pantogph holds and moves the device when fabric is held by said clamp means, so the fabric moves in an x-y plane relative to a sewing head of the embroidery machine, to enable embroidering of the fabric; the pantograph having two spaced apart arms, wherein said means for attaching comprises:

a frame having x-y axes corresponding with the x-y axes of the embroidering machine, the frame having opposing y axis ends with means for attachment to the pantograph clamp arms; and, wherein the clamp arm is attached to the frame.

5. The device of claim 4, wherein the frame has a C shape, wherein the clamp arm attached to the frame so the clamp arm cantilevers from the frame inwardly within the C shape.

6. The device of claim 5, wherein the clamp arm is approximately midway between the opposing y axis ends of the frame and runs in the y axis direction toward the opening of the C shape.

7. The device of claim 4, wherein the frame has a C shape, the frame having stubs adapted for use as handgrips on opposing sides of the opening of the C shape, for facilitating the attaching and detaching of the device from the pantograph.

8. The device of claim 2, wherein the frame comprises a member running generally in the y axis direction, the clamp arm attached to the member so the clamp arm cantilevers in the x axis direction.

9. The device of claim 4, wherein the frame has C shape, and wherein the device comprises a second clamp arm like the first clamp arm, the clamp arms attached to opposing sides of the clamp means and running in the x direction.

10. The device of claim 1, wherein the indicia comprise an orthogonal grid.

11. The device of claim 1, wherein the clamp means comprise two concentric mating rings, the first ring attached to the clamp arm, and the second ring detachable from the clamp arm for insertion and removal of fabric from between the rings, the diameters of the rings during use lying generally in the x-y plane.

12. The frame assembly of claim 1, wherein the clamp means further comprises:

a first plate having a multiplicity of openings, each opening shaped to receive a discrete piece of fabric which is somewhat larger than the opening;

at least one second plate having an opening which mates with an opening in the first plate, the second plate adapted to lie upon the first plate so the first and second plate openings align; and, means for pressing the second plate against the first plate, to thereby clamp a discrete piece of fabric between the first and second plates for embroidering;

wherein, the indicia are on the surface of the first plate which is visible prior to placing of the discrete piece of fabric on the first plate, and the clamping thereof by the second plate.

13. The frame assembly of claim 12, further comprising a second plate having a multiplicity of openings corresponding with the multiplicity of openings in the first plate.

14. The frame assembly of claim 12, further comprising a multiplicity of second plates, each having an opening which mates with an opening in the first plate.

15. A device for holding fabric in an embroidering machine which is adapted to move the fabric in an x-y plane during embroidering, which comprises:

a clamp arm:

clamp means comprising two mating rings, the first ring attached to the clamp arm, and the second ring detachable from the clamp arm for insertion and removal of fabric from between the rings, the diameters of the rings during use lying generally in the x-y plane, for releaseably holding the fabric;

means for attaching the clamp means to the embroidering machine in a predetermined x-y plane orientation; and, indicia upon a visible portion of the clamp means, the indicia fixedly positioned relative to the means for attaching, for enabling visual alignment of fabric with the indicia when the fabric is being clamped within the clamp means; wherein the indicia are visible to a user during and after the clamping of fabric within the clamp means.

16. The device of claim 15, wherein the indicia are on a surface of the first ring which lies in an x-y plane during use.

17. The device of claim 15, wherein at least one of the rings has a non-uniform height in the z axis direction.

18. The device of claim 15, wherein the indicia are around the inside diameter circumference of at least one of the rings.

19. A frame assembly or holding fabric in an embroidering machine which has a pantograph which moves in an x-y plane during embroidering, the pantograph having two spaced apart clamp arms, which comprises:

a frame, having x-y axes corresponding with the x-y axes of the embroidering machine, and having sides which at least circumscribe three sides of a generally rectangular interior space in the x-y plane, two of which frame sides are spaced apart along the y axis, means for releasably attaching the frame to the spaced apart clamp arms of the pantograph, attached to opposing sides of the frame which are spaced apart along the y axis;

a clamp arm, attached to the frame and extending into said interior space; and, clamp means, attached to the end of the clamp arm, for releasably holding the fabric.

20. The frame assembly of claim 19, wherein the frame is C shape in the x-y plane and has an opening along one y axis side, the clamp arm cantilevering into the interior space from the side of the frame opposite said opening in the frame.

21. The frame assembly of claim 19, wherein the frame has a C shape in the x-y plane, comprising two clamp arms, each clamp arm extending into the interior space from an opposing side of the frame and joined to the clamp means therebetween.

22. The frame assembly of claim 19, further comprising indicia upon a visible surface of the clamp arm, for enabling visual alignment of fabric with the indicia when the fabric is being clamped within the clamp means.

23. Apparatus for facilitating the clamping of a combination of fabric and backing paper in the clamp means of a frame assembly which is adapted for use in an embroidering machine having x, y and z axes, wherein the frame assembly comprises clamp means attached to a cantilever clamp arm, which apparatus comprises:

a base, having x and y axes;

means for holding the frame assembly in a x-y plane at a first z axis elevation, so the x and y axes of the frame assembly correspond with the x and y axes of the base, mounted on the base; and, a pair of tines, mounted on the base, for holding a backing sheet above the clamp means of the frame assembly prior to clamping of the fabric.

24. The apparatus of claim 23, further comprising a table mounted on the base, the cantilever table having a surface at a z axis elevation lower than said first z axis elevation, for supporting fabric being placed positioned for clamping in the clamp means of a frame assembly being held on the apparatus;

wherein, the tines are positioned on opposing y axis sides of the table;

wherein, when a frame assembly is mounted on the means for holding the frame assembly, the clamp means is positioned vertically above the cantilever table and between the pair of tines.

25. The apparatus of claim 23, further comprising a frame assembly for holding fabric in an embroidering machine which has a pantograph which moves in an x-y plane during embroidering, the pantograph having two spaced apart clamp arms, which frame assembly comprises:

a frame, having x-y axes corresponding with the x-y axes of the embroidering machine, and having sides which at least circumscribe three sides of a generally retangular interior space in the x-y plane, two of which frame sides are spaced apart along the y axis;

means for releasably attaching the frame to the spaced apart clamp arms of the pantograph, attached to opposing sides of the frame which are spaced apart along the y axis;

a clamp arm, attached to the frame and extending into said interior space; and, clamp means, attached to the end of the clamp arm, for releasably holding the fabric;

wherein, said means for holding the fame assembly engage said means for releasably attaching the frame.

* * * * *